United States Patent [19]

Becka

[11] 4,193,154

[45] Mar. 18, 1980

[54] TOE PULLING OVER AND LASTING MACHINE

[75] Inventor: Michael M. Becka, Nashua, N.H.

[73] Assignee: International Shoe Machine Corporation, Nashua, N.H.

[21] Appl. No.: 936,998

[22] Filed: Aug. 25, 1978

[51] Int. Cl.[2] ..... A43D 21/00

[52] U.S. Cl. ..... 12/10.1

[58] Field of Search ..... 12/10.1, 10.5, 10.4, 12/8.8, 14.5, 145

[56] References Cited

U.S. PATENT DOCUMENTS

| | | | |
|---|---|---|---|
| 3,099,846 | 8/1963 | Lane et al. | 12/10.1 |
| 3,348,250 | 10/1967 | Allgayer | 12/10.1 |

FOREIGN PATENT DOCUMENTS

| | | | |
|---|---|---|---|
| 1010149 | 11/1965 | United Kingdom | 12/10.1 |
| 1342081 | 12/1973 | United Kingdom | 12/10.1 |

*Primary Examiner*—Patrick D. Lawson

*Attorney, Agent, or Firm*—Albert Gordon

[57] ABSTRACT

A toe pulling over and lasting machine operable on a shoe assembly formed of a last having an insole located on its bottom and an upper mounted thereon. The machine includes a support for supporting the shoe assembly bottom-down, a toe pincers operable to grip the toe end extremity of the upper margin, side pincers located on each side of and forwardly of the toe pincers operable to grip the upper margin heelwardly of the toe end extremity of the upper margin, and wipers operable to wipe the toe portion of the upper margin against the insole. Circuitry, actuated by a pedal operated control valve, causes the machine to go through its cycle. A three position selector valve is incorporated in the circuitry to determine positions, if any, the machine assumes when it comes to a halt during the machine cycle with a reactuation of the control valve causing the machine to resume the machine cycle after it comes to a halt.

1 Claim, 5 Drawing Figures

TOE PULLING OVER AND LASTING MACHINE

BACKGROUND OF THE INVENTION

British patent specification No. 1342081 discloses a circuit for operating the toe pulling over and lasting machine of British patent specification No. 1010149, the latter specification corresponding to U.S. Pat. No. 3,099,846. This prior art machine is operable on a shoe assembly that includes a last having an insole located on its bottom and an upper mounted thereon and comprises: a support for supporting the shoe assembly bottom-down; a toe pincers operable to grip the upper margin proximate to its toe end extremity; at least one side pincers located on each side of and forwardly of the toe pincers operable to grip the upper margin heelwardly of the portion of the upper margin gripped by the toe pincers; upper stretching means for effecting relative upward movement of the support with respect to the toe and side pincers to stretch the toe portion of the upper about the last; optionally operable pincers adjusting means for thereafter selectively adjusting each of the pincers heightwise to relocate the stretched upper about the last; wiping means actuable to wipe the toe portion of the upper margin against the insole; circuit means for causing the machine to first go through a preliminary stage wherein the toe pincers are actuated to grip the upper margin, then go through a primary stage wherein the side pincers are actuated to grip the upper margin and the upper stretching means is actuated, and then go through a secondary stage that is concluded by actuation of the wiping means; and a control for operating the circuit means as aforesaid.

The prior art machine has a selector movable between a first position and a second position. Circuitry so connects the control (disclosed in British specification No. 1342081 as a treadle), the circuit means, and the selector that when the selector is in a first position, a first actuation of the control (disclosed as a partial depression of the treadle) causes the machine to go through the preliminary stage after which the machine comes to a halt to enable the operator to place the upper margin properly in the side pincers, a second actuation of the control (disclosed as a full depression of the treadle followed by a release of the treadle) causes the machine to go through the primary stage and then come to a halt to enable actuation of the pincers adjusting means, and a third actuation of the control (disclosed as a second full depression of the treadle) causes the machine to go through the secondary stage. When the selector of the prior art machine is in its second position, a first actuation of the control causes the machine to go through the preliminary stage after which the machine comes to a halt and a second actuation of the control causes the machine to automatically go through the primary stage and the secondary stage without coming to a halt between the primary stage and the secondary stage.

SUMMARY OF THE INVENTION

With certain types of shoe assemblies, it has been found to be unnecessary to stop the machine at the end of the preliminary stage as well as at the end of the primary stage as it suffices for the operator to place the upper margin in all of the pincers before starting the machine without placing the upper margin in the side pincers after the toe pincers have gripped the upper margin. The object of this invention is to so modify the prior art machine as to enable it to automatically go through all of the stages without coming to a halt between any of the stages and thus shorten the machine cycle. This is accomplished by providing a third position of the selector and so connecting the selector, the circuit means and the control that when the selector is in its third position a single actuation of the control causes the machine to automatically go through the preliminary stage, the primary stage, and the secondary stage without coming to a halt between any of these stages.

DESCRIPTION OF THE PREFERRED EMBODIMENT

Figure 1:
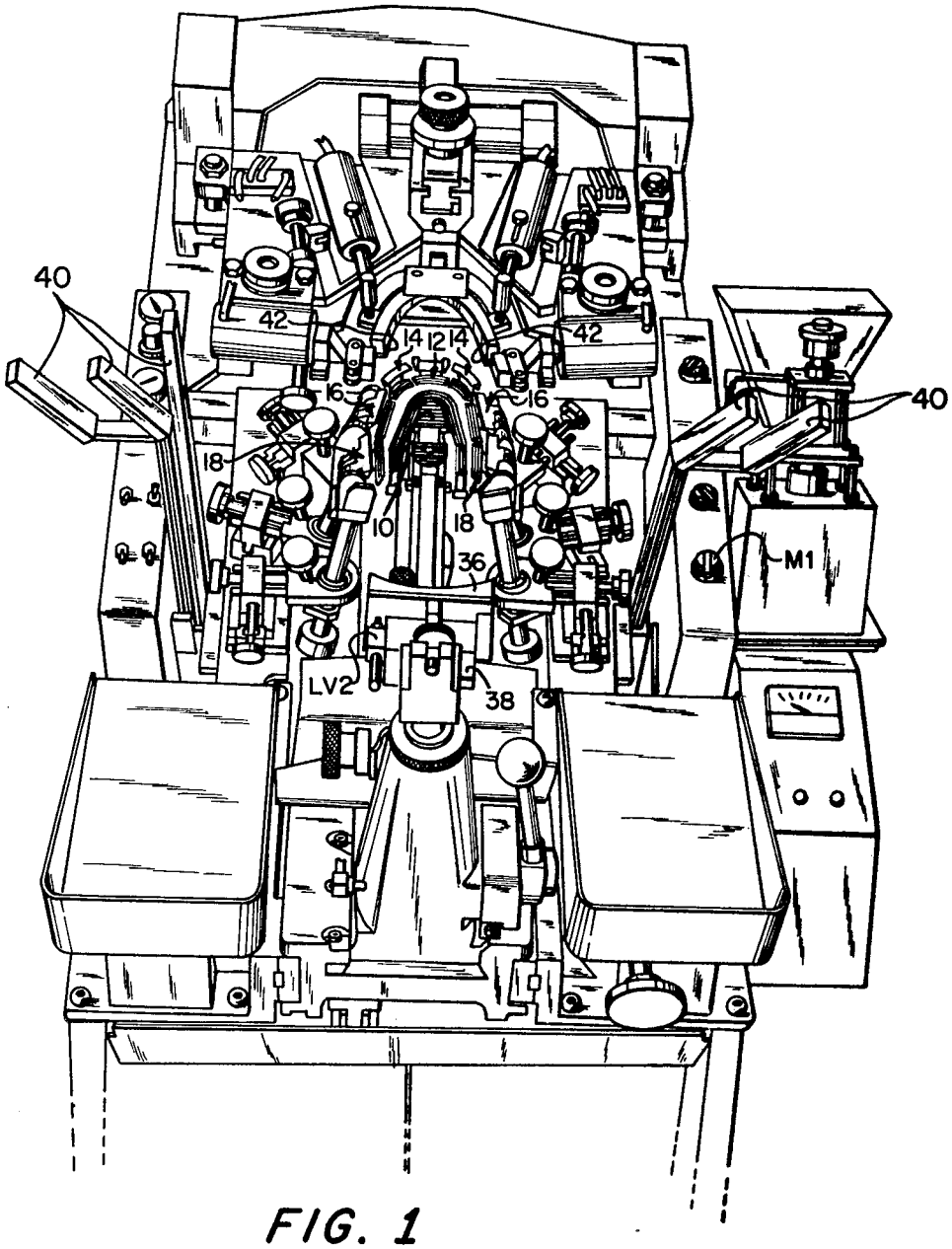
FIG. 1 is a front view of the machine.

The operator is intended to stand in front of the machine as seen in FIG. 1. Machine parts closest to the operator are considered to be at the front of the machine and machine parts furthermost from the operator are considered to be at the back of the machine. Parts moving toward the operator are considered to have "forward" movement and parts moving away from the operator are considered to have "rearward" movement.

The machine is inclined for ease of presentation of shoe assemblies thereto. However, for ease of explanation, the plane of the top of the insole rest 10 (see FIG. 3) referred to below will be considered to be a horizontal plane.

Referring to FIG. 1, the machine includes the insole rest 10. A toe pincers assembly 12 is located rearwardly of the insole rest 10 and side pincers assemblies 14 and 16 are located on each side of the insole rest 10 forwardly of and on each side of the toe pincers assembly 12. The side pincers assemblies 14 which are the rearmost side pincers assemblies closest to the toe pincers assembly 12 are corner pincers assemblies. The side pincers assemblies 16 which are forward of the corner pincers assemblies are forepart pincers assemblies. Ball pincers assemblies 18 are located on each side of the insole rest 10 and forwardly of the forepart pincers assemblies 16. A pincers 20 having relatively movable pincers jaws (see FIG. 3) is mounted to the top of each pincers assembly. An air actuated motor in each pincers assembly effects heightwise movements of the pincers assemblies and another air actuated motor in each pincers assembly effects opening and closing movement of the pincers 20 in the manner explained in U.S. patent application Ser. Nos. 932,596 and 932,581 filed Aug. 10, 1978.

The ball pincers assemblies 18, in addition to being movable heightwise, are each connected to an air operated motor 21 (FIG. 2) to effect forward-rearward movement of the ball pincers assemblies in the manner disclosed in U.S. patent applications Ser. Nos. 932,956 and 932,581.

The insole rest 10 is connected to an air operated motor to effect heightwise movement of the insole rest as disclosed in patent applications Ser. Nos. 932,596 and 932,581.

In the idle condition of the machine, all of the pincers assemblies 12, 14, 16, and 18 are in raised positions, the ball pincers assemblies 18 being so constructed that their pincers 20 are at higher elevations than the pincers 20 of the pincers assemblies 12, 14, and 16; the pincers 20 of all of the pincers assemblies 12, 14, 16, and 18 are open; the ball pincers assemblies 18 are retained in forward positions by the motors 21; and the insole rest 10 is in a lower position.

Figure 3:
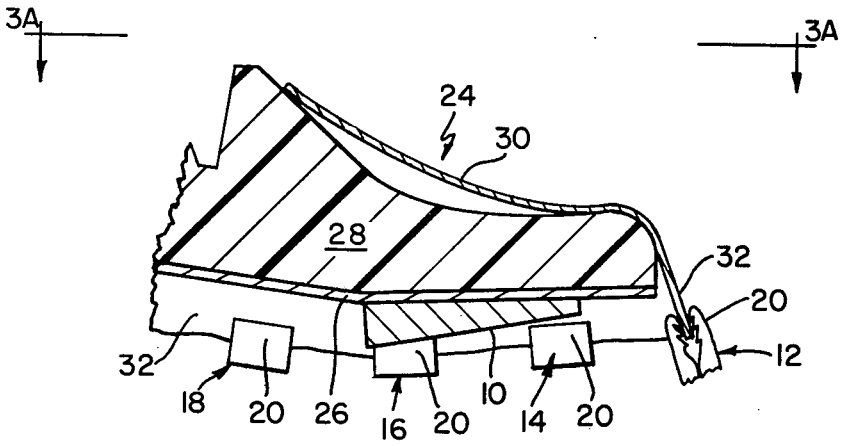
FIG. 3 is a representation of a shoe assembly in the machine.
Figure 3A:
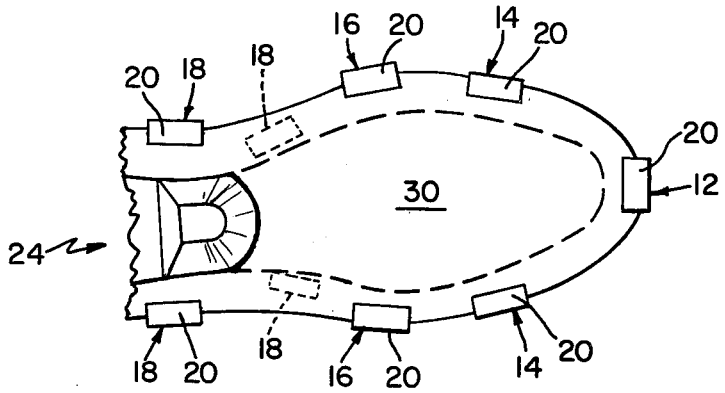
FIG. 3A is a view taken on the line 3A—3A of FIG. 3.

Referring to FIGS. 3 and 3A, a shoe assembly 24 is presented bottom-down to the machine. The shoe assembly 24 comprises a shoe insole 26 located on the bottom of a last 28 and a shoe upper 30 draped over the last.

Figure 4:
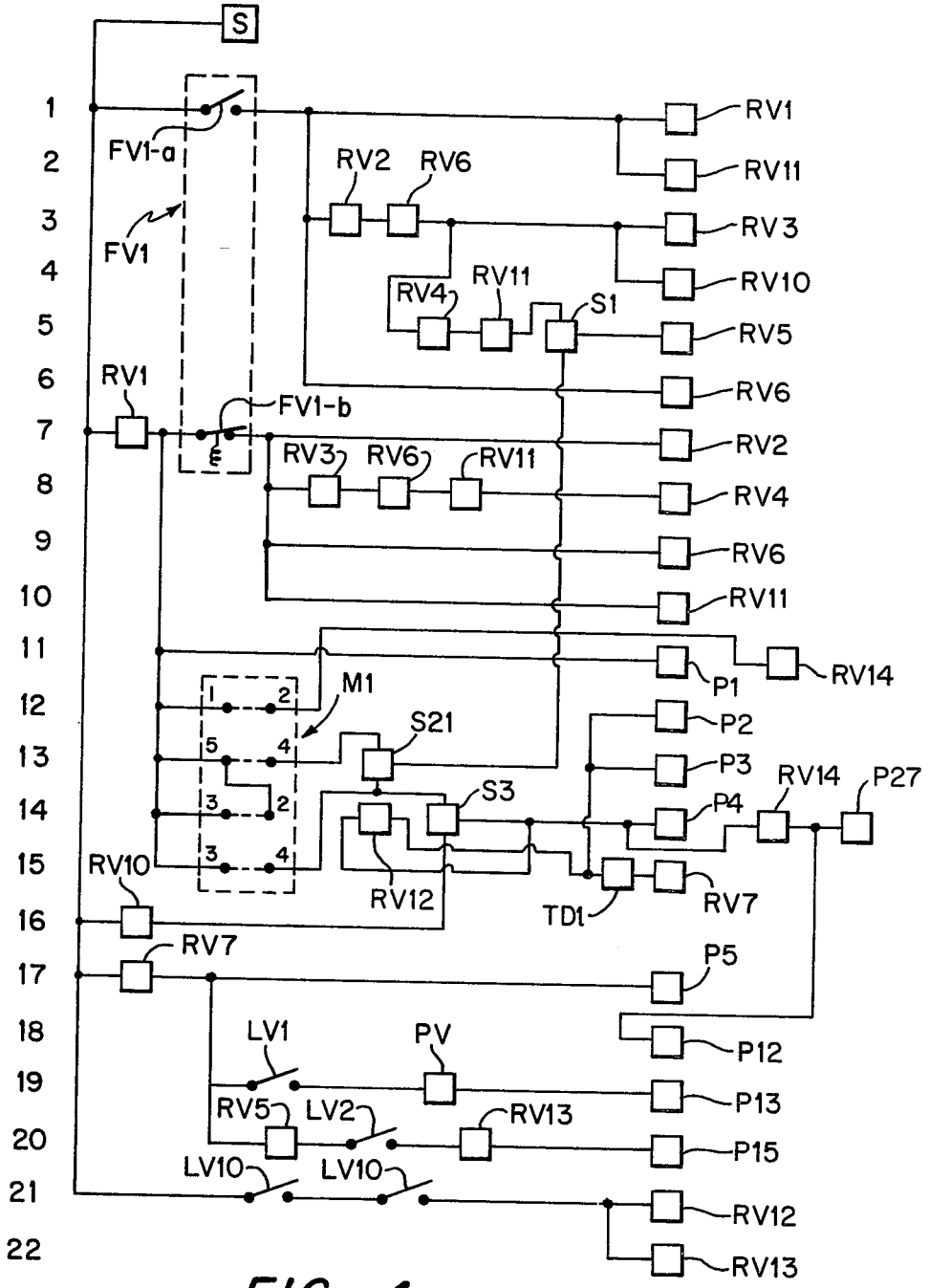
FIG. 4 is a schematic representation of a portion of the machine control circuit.

FIG. 4 is a schematic representation of a portion of the pneumatic control circuit of the machine. In the description of this control circuit, a valve will be deemed to be in passing condition when air can flow through the valve and will be deemed to be in non-passing condition when air cannot flow through the valve. The lines referred to below in describing the control circuit are the lines set out on the left side of FIG. 4.

The control circuit includes a control valve FV1 that includes a valve element **FV1-*a* and a valve element FV1-*b*. The two valve elements are mechanically so interlocked that when the valve element FV1-*a* is in non-passing condition the valve element FV1-*b* is in passing condition and vice versa. The two valve elements are resiliently urged into the position shown in FIG. 4 wherein valve element FV1-*a* is in non-passing condition and valve element FV1-*b* is in passing condition. A depression of the valve FV1 by the operator's foot places valve element FV1-*a* in passing condition and valve element FV1-*b* in non-passing condition and a release of the valve FV1 by the operator's foot returns valve element FV1-*a* to non-passing condition and returns valve element FV1-*b*** to passing condition.

The control circuit includes a selector valve M1 mounted on the machine frame (see FIG. 1). The selector valve M1, as indicated in FIG. 4, has four terminal pairs 1-2, 5-4, 3-2, and 3-4 and the selector valve M1 is so constructed that these terminal pairs may selectively be rendered in passing or non-passing condition depending on the manual setting of this valve.

In a first setting of the selector valve M1, the terminal pair 1-2 is passing and the terminal pairs 5-4, 3-2, and 3-4 are non-passing. The operator puts the toe portion of the insole 26 on the insole rest 10 and inserts the toe end extremity of the margin 32 of the upper 30 between the pincers 20 of the toe pincers assembly 12 and steps on the valve FV1 for a short time so as to first render valve element **FV1-*a* passing and valve element FV1-*b* non-passing and then render valve element FV1-*a* non-passing and valve element FV1-*b* passing. The rendering of valve element FV1-*a* passing and valve element FV1-*b* non-passing enables air to pass from a source S through valve element FV1-*a* to a relay valve RV1 to so shift relay valve RV1 as to render this relay valve passing on line 7. The rendering of relay valve RV1 passing on line 7 enables air to flow through this relay valve to power valve P1 on line 11 in such a manner as to cause the air operated motor controlling the pincers 20 of the toe pincers assembly 12 to close this pincers on the toe end extremity of the upper margin 32**.

The rendering of valve element **FV1-*a* passing and valve element FV1-*b* non-passing also enables air to flow through valve element FV1-*a* to relay valve RV11 on line 2 to so shift this relay valve as to render it passing on line 5 and non-passing on line 8**.

The rendering of valve element **FV1-*a* passing and valve element FV1-*b* non-passing also enables air to flow through valve element FV1-*a* to relay valve RV6 on line 6 to render this relay valve passing on line 3 and non-passing on line 8**.

The aforementioned rendering of relay valve RV1 passing on line 7 enables air to flow through relay valve RV1 on line 7 and through terminal pair 1-2 of the selector valve M1 to a relay valve RV14 on line 11 to render this valve passing on line 14.

The release of the valve FV1 by the operator so as to render valve element **FV1-*a* non-passing and valve element FV1-*b* passing enables air to flow through relay valve RV1 and valve element FV1-*b* on line 7 to a relay valve RV2 on line 7 to render relay valve RV2 passing on line 3**.

The rendering of valve element **FV1-*a* non-passing and valve element FV1-*b* passing also enables air to flow through relay valve RV1 and valve element FV1-*b* on line 7 to a port of relay valve RV6 on line 9 so as to render this relay valve non-passing on line 3 and passing on line 8**.

The rendering of valve element **FV1-*a* non-passing and valve element FV1-*b* passing also enables air to flow through relay valve RV1 and valve element FV1-*b* on line 7 to a port of relay valve RV11 on line 10 so as to render this valve non-passing on line 5 and passing on line 8**.

The machine now comes to a stop and the operator places the upper margin 32 between the pincers 20 of the side pincers assemblies 14 and 16 and the ball pincers assemblies 20. The operator then again steps on the valve FV1 for a short time so as to first render valve element **FV1-*a* passing and valve element FV1-*b* non-passing and then render valve element FV1-*a* non-passing and valve element FV1-*b* passing. This rendering of valve element FV1-*a* passing and valve element FV1-*b* non-passing causes air to again flow through valve element FV1-*a* to relay valve RV11 on line 2 so as to render this relay valve passing on line 5 and non-passing on line 8 and also causes air to again flow through valve element FV1-*a* to relay valve RV6 on line 6 to render this relay valve passing on line 3 and non-passing on line 8**.

The rendering of relay valve RV6 passing on line 3 enables air to flow through valve element **FV1-*a* and through relay valves RV2 and RV6 on line 3 to relay valve RV3 on line 3 so as to render this relay valve passing on line 8**.

The rendering of relay valve RV6 passing on line 3 also enables air to flow through valve element **FV1-*a* and through relay valves RV2 and RV6 on line 3 to relay valve RV10 on line 4 so as to render this relay valve passing on line 16. The rendering of relay valve RV10 passing on line 16 enables air to flow through this relay valve and through a shuttle valve S3 to a power valve P4 on line 14 in such a manner as to enable air to so flow through the power valve P4 to the air operated motor controlling the pincers 20 of the ball pincers assemblies 18 as to close these pincers on the ball portions of the upper margin 32**.

The rendering of relay valve RV10 passing on line 16 also enables air to flow from shuttle valve S3 through relay valve RV14 on line 14 to a power valve P27. The power valve P27 is so connected to the air operated motors 21 that effects forward-rearward movement of the pincers 20 of the ball pincers assemblies 18 as to cause these motors to effect rearward and toeward movements of these pincers.

Figure 2:
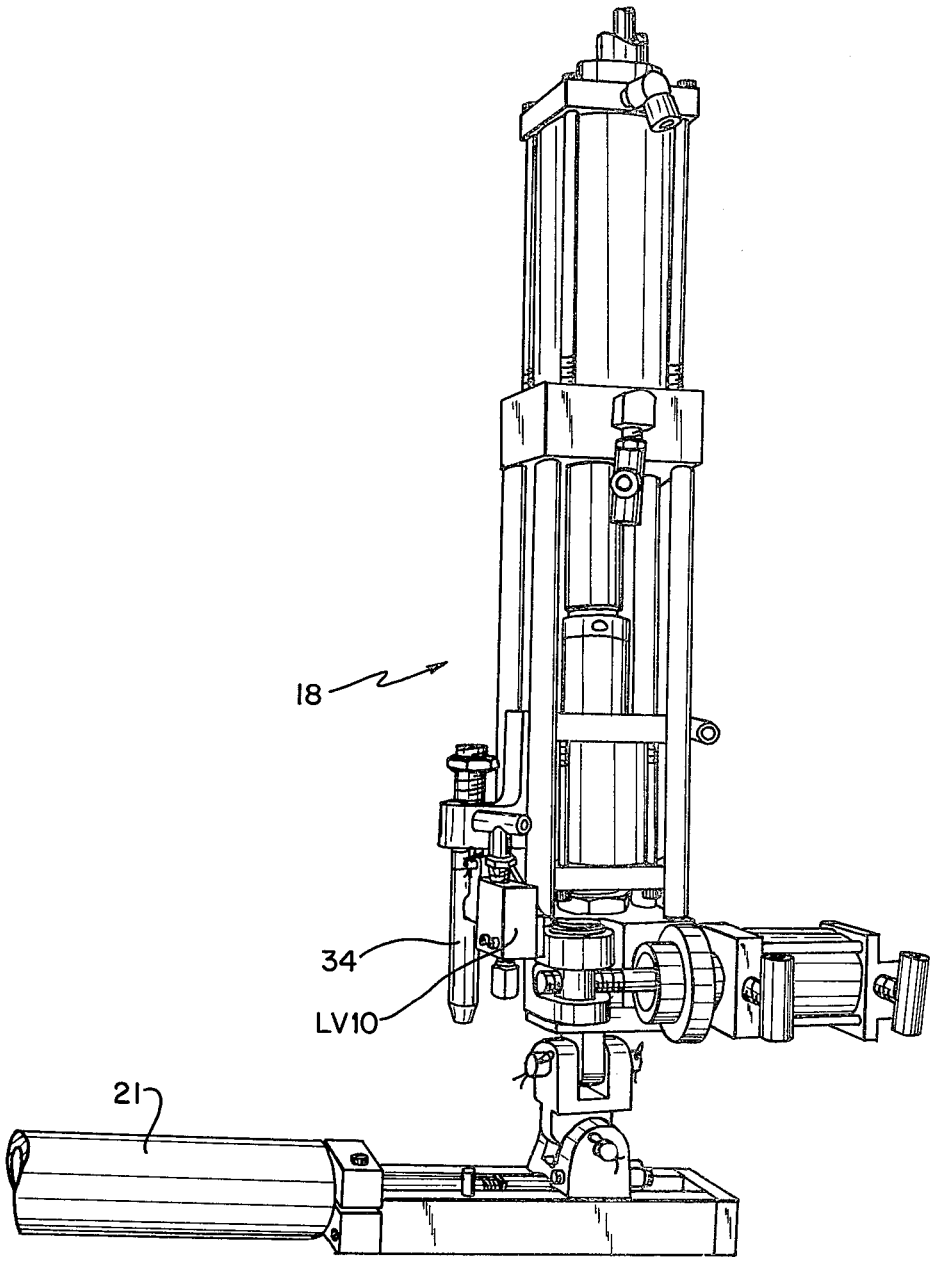
FIG. 2 is a view of a part of a ball pincers assembly.

The rendering of relay valve RV10 passing on line 16 also enables air from the relay valve RV14 to flow to a power valve P12 on line 18. The power valve P12 is so connected to the air operated motors that effect heightwise movements of the ball pincers assemblies 18 as to cause these motors to lower these pincers assemblies. Referring to FIG. 2, the lowering of the ball pincers assemblies 18 causes a cam 34 mounted to each of these pincers assemblies to engage a valve LV10 in such a manner as to shift these valves, shown in line 21 of FIG. 4, from non-passing to passing condition. The rendering of the valves LV10 passing enables air to flow through these valves on line 21 to a relay valve RV12 on line 21 to render this relay valve passing on line 14. The rendering of relay valve RV12 passing on line 14 enables air to flow through relay valve RV10 on line 16 through shuttle valve S3 and relay valve RV12 on line 14 to a pneumatic timer TD1 on line 15.

The air flowing through relay valve RV12 on line 14 also flows to power valve P2 on line 12 and power valve P3 on line 13. The power valves P2 and P3 are respectively so connected to the pincers operating air motors of the side pincers assemblies 14 and 16 as to cause these motors to close the pincers 20 of the side pincers assemblies on the upper margin 32.

The air flowing through valves LV10 on line 21 also flows to relay valve RV13 on line 22 to render this relay valve passing on line 20.

A preset interval after the air has flowed to the timer TD1 on line 15, the air flows through this timer to relay valve RV 7 on line 15 to render this relief valve passing on line 17. The rendering of relief valve RV7 passing on line 17 enables air to flow through this relief valve to power valve P5 on line 17. The power valve P5 is so connected to the air operated motor that effects heightwise movement of the insole rest 10 as to actuate this motor to raise the insole rest while the upper margin 32 is gripped by all of the pincers 20 to thereby cause the toe portion of the upper 30 to be stretched about the last 28.

A valve LV1 on line 19 is so constructed, in a manner similar to the construction of the valve 52 in U.S. Pat. No. 3,902,211, as to be shifted in response to the completion of the rise of the insole rest 10. The shifting of the valve LV1 changes it from a non-passing to a passing condition so that air flows from the relay valve RV7 on line 17 through the valve LV1 and a pulse valve PV on line 19 to a power valve P13 on line 19. The machine includes a heel clamp 36 (FIG. 1) mounted to the machine for forward-rearward movement towards and away from the heel end of the shoe assembly 24. An air operated motor is so connected to the heel clamp 36 as to effect its forward-rearward movement in a manner similar to that disclosed in U.S. Pat. No. 3,397,417. The power valve P13 is so connected to the motor effecting movement of the heel clamp 36 as to cause this motor to move the heel clamp rearwardly against the heel end of the shoe assembly 24. As shown in FIG. 1, the heel clamp 36 is mounted to a bracket 38, this mounting being such that the heel clamp 36 is yieldably urged rearwardly of the bracket 38. A valve LV2 is so mounted to the bracket 38 as to be shifted from non-passing to passing condition on line 20 of FIG. 4 pursuant to forward movement of the heel clamp 36 relative to the bracket 38 in response to the engagement of the heel clamp with the heel end of the shoe assembly 24.

The second release of the control valve FV1 by the operator so as to render valve element FV1-*a* non-passing and valve element FV1-*b* passing enables air to again flow through valve element FV1-*b* to relay valve RV6 on line 9 to render this relay valve non-passing on line 3 and passing on line 8 and also enables air to again flow through valve element FV1-*b* to relay valve RV11 on line 10 to render this valve non-passing on line 5 and passing on line 8.

Due to relay valves RV3, RV6, and RV11 now being passing on line 8, air flows through valve element FV1-*b* and through these relay valves on line 8 to relay valve RV4 on line 8 to render relay valve RV4 passing on line 5.

The machine now comes to a stop and, at this time, in the manner and by the mechanism shown in U.S. Pat. No. 4,155,135, the operator may selectively manipulate handles 40 (FIG. 1) to thereby selectively lower desired pincers 20 of the pincers assemblies 12, 14, and 16 to thereby reposition the toe of the upper 30 about the last 28 if the stretched upper was not properly positioned for the subsequently performed toe wiping operation after the insole rest 10 completed its rise.

The operator again steps for a short time on the control valve FV1 to first render valve element FV1-*a* passing and valve element FV1-*b* non-passing and then render valve element FV1-*a* non-passing and valve element FV1-*b* passing. The rendering of valve element FV1-*a* passing and valve element FV1-*b* non-passing again enables air to flow through valve element FV1-*a* to relief valve RV11 on line 2 to render this relief valve passing on line 5 and non-passing on line 8 and also enables air to flow through valve element FV1-*a* to relief valve RV6 on line 6 to render this relief valve passing on line 3 and non-passing on line 8. As a result, air now flows through valve element FV1-*a*, relief valves RV2 and RV6 on line 3, and relief valves RV4 and RV11 on line 5 through a shuttle valve S1 to a relief valve RV5 on line 5 to render relief valve RV5 passing on line 20.

The rendering of relief valve RV5 passing on line 20 enables air to pass from relief valve RV7 on line 17 through relief valve RV5, valve LV2 and relief valve RV13 on line 20 to a power valve P15 on line 20.

The remainder of the machine cycle is similar to that of the machines disclosed in U.S. Pat. No. 4,155,135, in U.S. Pat. No. 3,902,211, and in British patent specification number 1,341,967. The machine includes a slide plate, constructed similarly to the slide plate shown in U.S. Pat. No. 3,397,417, which carries toe wipers 42 (FIG. 1) and which is mounted for forward-rearward movement by an air operated motor, this motor being so connected to the power valve P15 as to cause this motor, in response to the passage of air to the power valve P15, to move the slide plate forwardly. Following this forward movement of the slide plate, the shoe assembly is clamped in position on the insole rest 10, adhesive is extruded onto the periphery of the toe portion of the insole 26, and the toe portion of the upper margin 32 is wiped by the wipers 42 against the corresponding portion of the periphery of the insole 26 with the various pincers 20 releasing the stretched upper margin at such times as to enable the wipers 42 to effect the wiping operation.

In a second setting of the selector valve M1, the terminal pairs 5-4 and 3-2 are passing and the terminal pairs 1-2 and 3-4 are non-passing. When operating on a shoe assembly 24, using this setting of the selector valve M1, the operator puts the toe portion of the insole 26 on the insole rest 10 and inserts the upper margin 32 between the pincers 20 of the toe pincers assembly 12. The operator then steps on the control valve FV1 for a short time so as to first render valve element FV1-*a* passing and valve element FV1-*b* non-passing and then render valve element FV1-*a* non-passing and valve element FV1-*b* passing. As with the first setting of the selector valve M1, this rendering of valve element FV1-*a* passing and valve element FV1-*b* non-passing enables relay valve RV1 on line 1 to be shifted so as to render this relay valve passing on line 7, enables relay valve RV11 on line 2 to be shifted to render this relay valve passing on line 5 and non-passing on line 8, and enables relay valve RV6 on line 6 to be shifted so as to render this relay valve passing on line 3 and non-passing on line 8. The changing of relay valve RV1 to passing on line 7 causes air to flow through this relief valve to power valve P1 on line 11 to thereby cause the pincers 20 of the toe pincers assembly 12 to grip the toe end portion of the upper margin 32, as described above with respect to the first setting of the selector valve M1.

The changing of relay valve RV1 to passing on line 7 also enables air to pass from relay valve RV1 through terminal pair 3-2 of valve M1, a line connecting terminals 2 and 5 of valve M1, terminal pair 5-4 of valve M1 and shuttle valves S21 and S1 to relay valve RV5 to so shift this relay valve as to render it passing on line 20.

The last mentioned rendering of valve element FV1-*a* non-passing and valve element FV1-*b* passing has the same results as is achieved upon release of the control valve FV1 after the first depression of the control valve FV1 when the selector valve M1 is in its first setting.

The machine now comes to a stop. The operator now places the upper margin between the pincers 20 of the pincers assemblies 14, 16, and 18 and again steps on the control valve FV1 for a short time so as to first render valve element FV1-*a* passing and valve element FV1-*b* non-passing and then render valve element FV1-*a* non-passing and valve element FV1-*b* passing. This has the same results as takes place in response to the second depression and release of the control valve FV1 when the selector valve M1 is in its first setting, namely causing the pincers 20 of the ball pincers assemblies 18 to grip the upper margin 32, effecting rearward and toeward movement and lowering movement of the pincers 20 of the ball pincers assemblies 18, effecting the closing of the pincers 20 of the side pincers assemblies 14 and 16 on the upper margin 32, effecting the raising of the insole rest 10, and effecting rearward movement of the heel clamp 36 against the heel end of the shoe assembly 24.

Since the relief valve RV5 was previously shifted when the selector valve M1 is in its second position so as to render this relief valve passing on line 20, the machine does not come to a stop when the heel clamp 36 comes to bear against the heel end of the shoe assembly but continues automatically through the remainder of the machine cycle.

In a third setting of the selector valve M1, terminal pair 3-4 is passing and terminal pairs 1-2, 5-4, and 3-2 are non-passing. When operating on a shoe assembly 24, using this setting of the selector valve M1, the operator places the toe portion of the insole 26 on the insole rest 10 and inserts the upper margin 32 between the pincers 20 of all of the pincers assemblies 12, 14, 16, and 18. The operator then steps on the valve FV1 for a short time so as to first render valve element FV1*a* passing and valve element FV1-*b* non-passing, and then render valve element FV1-*a* non-passing and valve element FV1-*b* passing. As with the first and second settings of the selector valve M1, this enables relay valve RV1 on line 1 to be shifted so as to render this relay valve passing on line 7. The changing of relay valve RV1 to passing on line 7 enables air to flow through this relief valve to power valve P1 on line 11 to cause the pincers 20 of the toe pincers assembly 12 to grip the toe end portion of the upper margin 32, as described above with respect to the first setting of the selector valve M1.

The changing of relief valve RV1 to passing on line 7 also enables air to flow from this relief valve through the terminal pair 3-4 of selector valve M1 and through shuttle valve S3 to power valve P4 on line 14 and enables air to flow from the terminal pair 3-4 of selector valve M1 through shuttle valve S21 and shuttle valve S1 to relief valve RV5 on line 5 to so shift this relief valve as to render it passing on line 20. As described above with respect to the first setting of the selector valve M1, the air going to power valve P4 causes the pincers 20 of the ball pincers assemblies 18 to grip the ball portions of the upper margin 32 which is followed by rearward and lowering movements of these pincers, the closing of the pincers 20 of the side pincers assemblies 14 and 16 on the upper margin 32, the raising of the insole rest 10, and the rearward movement of the heel clamp 36 against the heel end of the shoe assembly 24. The rendering of the relief valve RV5 passing on line 20 enables the machine cycle to automatically continue through the remainder of the machine cycle.

There follows a recapitulation of the description of the machine and its mode of operation that pertain to this invention.

The machine is a toe pulling over and lasting machine operable on the shoe assembly 24 that includes the last 28 having the insole 26 located on its bottom and the upper 30 mounted thereon. The machine comprises: the insole rest 10, which forms a support, for supporting the shoe assembly bottom-down, the toe pincers 20 of the toe pincers assembly 12 that is operable to grip the upper margin 32 proximate to its toe and extremity, and the side pincers 20 of the side pincers assemblies 14 and 16 that are located on each side of and forwardly of the toe pincers and are operable to grip the upper margin 32 heelwardly of the portion of the upper margin gripped by the toe pincers. The air operated motor connected to the support 10 for effecting its upward movement forms upper stretching means for effecting relative upward movement of the support 10 with respect to the pincers 20 to stretch the toe portion of the upper 30 about the last 28. The mechanism shown in U.S. Pat. No. 84,155,135 actuable in response to manipulation of the handles 40 to shift the pincers 20 heightwise acts as optionally operable pincers adjusting means for thereafter selectively adjusting the pincers 20 heightwise to relocate the stretched upper 30 about the last 28. The wipers 42 serve as wiping means actuable to wipe the toe portion of the upper margin 32 against the insole 26. The machine control circuit, part of which is shown in FIG. 4, acts as circuit means for causing the machine to first go through a preliminary stage wherein the toe pincers are actuated to grip the upper margin 32, then go a primary stage wherein the side pincers are actuated to grip the upper margin and the upper stretching means is actuated, and then go through a secondary stage that is concluded by actuation of the wiping means 42. The control valve FV1 serves as a control for operating the circuit means as aforesaid. The selector valve M1 serves as a selector that is movable between a first position and a second position. Circuitry, shown in FIG. 4, so connects the control FV1, the circuit means and the selector M1 that, when the selector is in its first position, a first actuation of the control FV1 (herein disclosed as a depression and release of the control FV1) causes the machine to go through the preliminary stage after which the machine comes to a halt to enable the operator to place the upper margin properly in the side pincers, a second actuation of the control FV1 causes the machine to to through the primary stage and then come to a halt to enable actuation of the pincers adjusting means, and a third actuation of the control FV1 causes the machine to go through the secondary stage and that, when the selector M1 is in its second position, a first actuation of the control FV1 causes the machine to go through the preliminary stage and then come to a halt and a second actuation of the control FV1 causes the machine to automatically go through the primary stage and the secondary stage without coming to a halt between the primary stage and the secondary stage.

The machine described in the preceding paragraph is improved, in accordance with this invention, by so constructing the selector M1 that it is also movable to a third position and the circuitry so connects the control FV1, the circuit means and the selector M1 that when the selector is in its third position a single actuation of the control causes the machine to automatically go through the preliminary stage, the primary stage and the secondary stage without coming to a halt between any of these stages.

I claim:

1. A toe pulling over and lasting machine operable on a shoe assembly that includes a last having an insole located on its bottom and an upper mounted thereon comprising: a support for supporting the shoe assembly bottom-down; a toe pincers operable to grip the upper margin proximate to its toe end extremity; at least one side pincers located on each side of and forwardly of the toe pincers operable to grip the upper margin heelwardly of the portion of the upper margin gripped by the toe pincers; upper stretching means for effecting relative upward movement of the support with respect to the toe and side pincers to stretch the toe portion of the upper about the last; optionally operable pincers adjusting means for thereafter selectively adjusting each of the pincers heightwise to relocate the stretched upper about the last; wiping means actuable to wipe the toe portion of the upper margin against the insole; circuit means for causing the machine to first go through a preliminary stage wherein the toe pincers are actuated to grip the upper margin, then go through a primary stage wherein the side pincers are actuated to grip the upper margin and the upper stretching means is actuated, and then go through a secondary stage that is concluded by actuation of the wiping means; a control for operating the circuit means as aforesaid; a selector movable between a first position and a second position; and circuitry so connecting the control, the circuit means, and the selector that when the selector is in its first position a first actuation of the control causes the machine to go through said preliminary stage after which the machine comes to a halt to enable the operator to place the upper margin properly in the side pincers, a second actuation of the control causes the machine to go through said primary stage and then come to a halt to enable actuation of the pincers adjusting means, and a third actuation of the control causes the machine to go through the secondary stage, and that when the selector is in its second position a first actuation of the control causes the machine to go through said preliminary stage and then come to a halt and a second actuation of the control causes the machine to automatically go through the primary stage and the secondary stage without coming to a halt between the primary stage and the secondary stage; characterized in that the selector is movable into a third position and said circuitry so connects the control, the circuit means and the selector that when the selector is in its third position a single actuation of the control causes the machine to automatically go through the preliminary stage, the primary stage and the secondary stage without coming to a halt between any of these stages.

* * * * *

UNITED STATES PATENT AND TRADEMARK OFFICE

CERTIFICATE OF CORRECTION

PATENT NO. : 4193154

DATED : March 18, 1980

INVENTOR(S) : Michael M. Becka

It is certified that error appears in the above-identified patent and that said Letters Patent are hereby corrected as shown below:

Column 2: line 65, change "932,956" to --932,596--.

Signed and Sealed this

*Seventeenth* Day of *June 1980*

[SEAL]

*Attest:*

SIDNEY A. DIAMOND

*Attesting Officer*

*Commissioner of Patents and Trademarks*